United States Patent [19]

Seragnoli

[11] Patent Number: 4,557,277

[45] Date of Patent: Dec. 10, 1985

[54] MACHINE FOR MANUFACTURING CONTINUOUS CIGARETTE RODS SIMULTANEOUSLY

[75] Inventor: Enzo Seragnoli, Bologna, Italy

[73] Assignee: G. D. Societa' per Azioni, Bologna, Italy

[21] Appl. No.: 544,979

[22] Filed: Oct. 24, 1983

[30] Foreign Application Priority Data

Nov. 17, 1982 [IT] Italy ..... 3594 A/82

[51] Int. Cl.[4] ..... A24B 5/14

[52] U.S. Cl. ..... 131/84.3

[58] Field of Search ..... 131/108, 84 C, 109 R, 131/84 B, 84 R

[56] References Cited

U.S. PATENT DOCUMENTS 4,336,812 9/1982 Seragnoli ..... 131/84 R

FOREIGN PATENT DOCUMENTS 2942119 4/1981 Fed. Rep. of Germany .... 131/84 B

*Primary Examiner*—V. Millin

*Attorney, Agent, or Firm*—Marshall, O'Toole, Gerstein, Murray & Bicknell

[57] ABSTRACT

Machine for manufacturing continuous cigarette rods simultaneously, on which the tobacco for each rod is fed on a separate belt, in turn supplied by a separate feed channel the said feed channels being supplied with tobacco by a single conveyor belt designed to supply a continuous layer of tobacco which is divided into longitudinal strips, one for each channel, by jets of compressed fluid supplied by an air-powered dividing device set up facing the thickness of the said layer.

9 Claims, 3 Drawing Figures

MACHINE FOR MANUFACTURING CONTINUOUS CIGARETTE RODS SIMULTANEOUSLY

BACKGROUND OF THE INVENTION

The present invention relates to a machine for manufacturing continuous cigarette rods simultaneously. Manufacturing machines of the abovementioned type are already known, on which shredded tobacco is fed from an incoming feedbox on to a conveyor belt underneath through a combing unit which unloads the shredded tobacco on to the said conveyor in the form of a continuous, essentially uniform layer. For manufacturing a number of continuous cigarette rods simultaneously on the said known machines, the said continuous layer is fed simultaneously to a number of feed channels through which the tobacco is fed to the same number of out-going conveyors, each for producing one cigarette rod.

On the above known machines, the said continuous layer is usually divided up by sucking it off the conveyor belt and conveying the tobacco by means of an air jet which is divided into a number of secondary jets, one for each feed channel, by fixed or movable separating panels on the said channels.

Consequently, on the above known machines, the layer of tobacco coming off the combing unit is not divided up directly but indirectly by dividing the jet of air lifting the tobacco off the conveyor belt underneath.

Such a procedure obviously poses problems in that, though the said air jet can be divided into a number of preset secondary jets, e.g. all the same, it is not always possible to distribute the tobacco uniformly within the main stream. Consequently, it is not always possible to supply the outgoing belts with preset amounts of tobacco, e.g. exactly equal to each other. What is more, as the said main stream on known machines is divided into secondary streams directly by the separating panels on the said channels, the danger always exists of tobacco shreds overlapping the input edge of the panels, thus affecting the flow of air along the channels and uniform arrangement of the tobacco on the outgoing belts.

SUMMARY OF THE INVENTION

The aim of the present invention is to provide a machine for manufacturing continuous cigarette rods simultaneously and which provides for dividing the layer of tobacco from the said combing unit before it is sent to the inlet of the said channels, so as to overcome all the drawbacks posed by known machines of the same type.

With this aim in view, the present invention relates to a machine for manufacturing continuous cigarette rods simultaneously, consisting of an in-coming feedbox for supplying shredded tobacco to a combing unit which supplies a continuous layer of the said tobacco on to a conveyor belt for supplying a number of out-going channels, one for each of the said rods, the said channels being arranged side by side and crosswise in relation to the direction the said belt is travelling in, characterised by the fact that it consists of a dividing device facing the conveying surface of the said belt and consisting of means for supplying fluid under pressure and, for each pair of the said adjacent channels, at least one pair of nozzles for supplying the said fluid under pressure; the nozzles of each said pair being arranged facing the said conveying surface, at a greater distance from it than the thickness of the said layer, at an angle in relation to the said conveying surface, in the same direction as that in which the said conveyor surface is travelling and essentially symmetrical in relation to it; the speed at which the said fluid under pressure comes out of the said nozzles parallel to the said direction of feed being greater than the speed of the said conveying surface is travelling at.

BRIEF DESCRIPTION OF THE DRAWINGS

The invention will now be described, by way of a non-limiting example, with reference to the attached drawings in which.

DETAILED DESCRIPTION OF THE INVENTION

Figure 1:
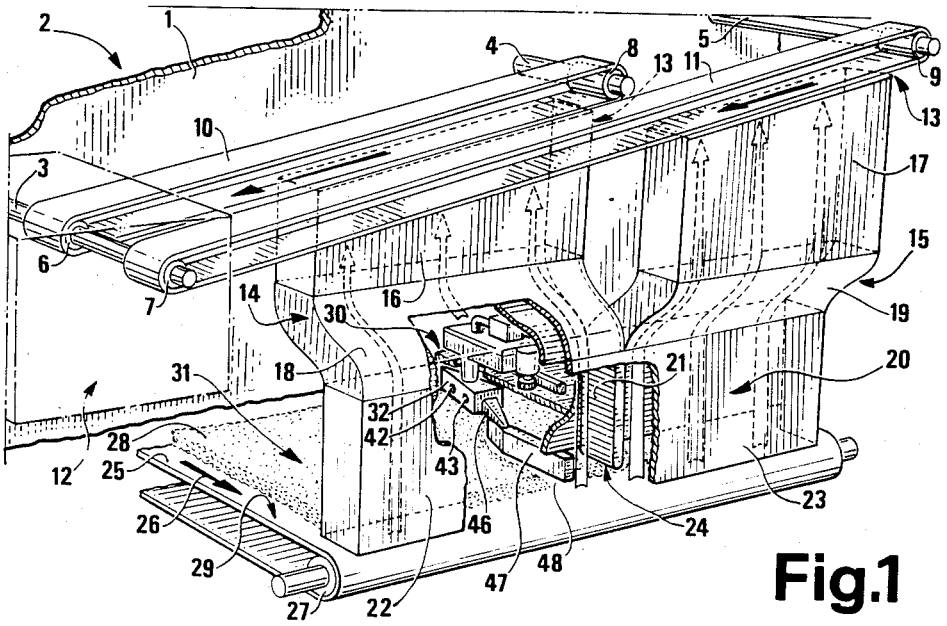
FIG. 1 shows a view in perspective, with parts removed for simplicity, of an out-going section of a cigarette manufacturing machine according to the present invention.

Number 1 in FIG. 1 indicates a vertical panel forming part of the bed on a cigarette manufacturing machine (2) designed to produce two cigarette rods (not shown) simultaneously. Panel 1 supports three rotary perpendicular shafts, marked 3, 4 and 5 from left to right in the diagram, the first set up below the other two and connected to drive means (not shown) for turning it anticlockwise.

Shaft 3 is fitted with two rollers, 6 and 7, arranged side by side with the first next to panel 1, while shafts 4 and 5 are fitted with rollers 8 and 9 respectively, arranged parallel to the said rollers 6 and 7.

Roller pairs 6–8 and 7–9 are looped over by belts 10 and 11 respectively the bottom faces of which are subjected to suction by means not shown on the diagram.

Downstream from belts 10 and 11, a section is provided for rolling tobacco in strips of paper, the said section being indicated as a whole by number 12. Underneath belts 10 and 11 are located the top ends (13) of two up channels (14, 15) with an elongated, essentially rectangular section the longitudinal axis of which is essentially parallel to belts 10 and 11. Channels 14 and 15 consist respectively of vertical top outlet sections 16 and 17 which blend respectively at the bottom into sections 18 and 19 arranged at an angle to a vertical plane between belts 10 and 11. The bottom ends of the said sections 18 and 19 communicate with cross section portions of a single, essentially vertical pipe (20). The latter has an elongated, essentially rectangular section, essentially equal in width to belts 10 and 11 and essentially twice as long as ends 13.

Pipe 20 is also provided inside with a cross flap (21) dividing it into two initial pipes or sections (22, 23) which communicate respectively with sections 18 and 19 and form inlet sections for channels 14 and 15 respectively. As the bottom edge (24) of flap 21 is raised in relation to the bottom end of pipe 20, pipes 22 and 23 have a relatively short bottom section in common.

Under the bottom openings of channels 14 and 15 is one end of an essentially horizontal conveyor belt (25) the direction of which, indicated by arrow 26, is essentially crosswise in relation to that of belts 10 and 11. Belt 25 is looped round a pair of rollers (27), only one of which is shown, and powered by drive means (not shown) so as to supply the bottom openings of channels 14 and 15 with a continuous, essentially uniform layer (28) of shredded tobacco from a combing unit (not shown) on the conveying surface (29) of belt 25.

Facing surface 29, a dividing device, indicated as a whole by the number 30, is fitted for dividing the said layer (28) of tobacco into a number of strips (31) moving in the direction of arrow 26 on surface 29.

Dividing device 30 consists of a prism-shaped hollow supporting body (32) with an essentially triangular base and essentially triangular internal chamber (33) pointing in the opposite direction to arrow 26. Hollow body 32 is connected to a free end of a tubular shaft (34) essentially perpendicular to surface 29 and sufficiently far from it to keep body 32 at a distance from surface 29 greater than the thickness of layer 28.

The end of shaft 34 opposite the one connected to body 32 is connected, so as to turn around a fixed axis, to slide 35, which runs along rail 36, parallel to arrow 26, powered by drive means consisting of a motor (37) for driving a rack and pinion assembly (38) between rail 36 and slide 35. The angle of shaft 34 is controlled by drive means consisting of motor 39, supported on slide 35 and connected to shaft 34 by bevel gear pair 40.

Figure 2:
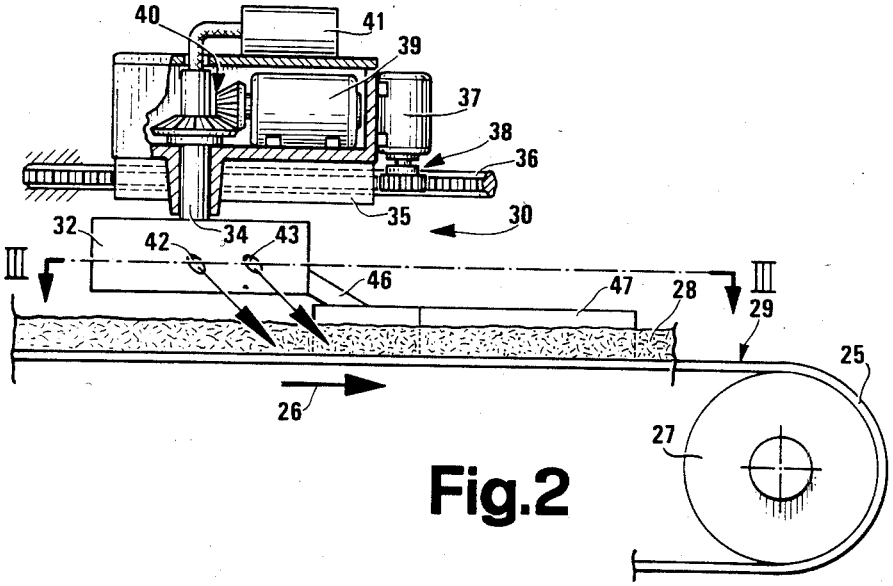
FIG. 2 shows a cross section of a detail in FIG. 1.

As shown in FIG. 2, slide 35 is fitted with a compressed air source (41) one outlet of which communicates with the inside of tubular shaft 34 and, through it, with chamber 33 on hollow body 32.

Figure 3:
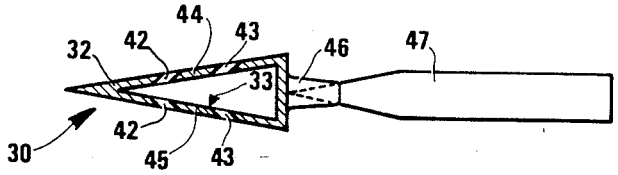
FIG. 3 shows a cross section along line III—III in FIG. 2.

As shown in FIGS. 2 and 3, chamber 33 comes out through two pairs of holes or nozzles (42, 43) one of which may be dispensed with. Nozzles 42 and 43 of each pair extend through opposite side panels (44 and 45) on body 32 and are arranged at an angle to both surface 29 and the direction of arrow 6 and at a diverging angle in relation to an axis on body 32 parallel to arrow 26.

At the downstream end of body 32, in the direction of belt 25 indicated by arrow 26, a dividing flap (47) is connected by means of bracket 46, the said flap being wedge-shaped at the end, extending parallel to arrow 26 and skimming surface 29 of belt 25.

When in use, the jets of compressed air aimed by nozzles 42 and 43 on to layer 28 moving along on belt 25 in the direction of arrow 26 shift aside the material moving under body 32 so as to form a strim (48) along which surface 29 remains clear. The axis of the said strim (48) is occupied by dividing flap 47 which may even be dispensed with and the function of which is to separate the air jets from nozzles 42 and 43 on opposite sides of body 32.

To clear strips 48, the speed of the compressed air jets in the direction of arrow 26 need not necessarily be high in relation to the speed of belt 25. The speed of the jets in the direction of arrow 26 need only be a few percent, e.g. 10% higher than that of belt 25.

Strips 31 formed on belt 25 by dividing device 30 are conveyed by belt 25 to the inlet end of channels 14 and 15 and, without touching flap 21, are sucked up on to the bottom faces of belts 10 and 11.

Dividing device 30 provides for accurate adjustment of the amount of tobacco supplied to each of channels 14 and 15. For example, by setting up a dynamic weighing device (not shown) underneath belt 25 and downstream from dividing device 30, the angle of body 32 in relation to the axis of shaft 34 can be controlled so as to make strips 31 perfectly equal in weight.

By means of drive motor 37, it is possible to regulate the point along belt 25 at which layer 28 is divided into strips according to the position of channels 14 and 15 and the chracteristics of the tobacco being conveyed, so as to enable the tobacco shifted aside to clear strip 26 to settle completely before it reaches channels 14 and 15.

To those skilled in the art it will be clear that changes can be made to the machine (2) described by way of a nonlimiting example without, however, departing from the scope of the present invention.

For example, in an alternative arrangement not shown, shaft 34 may be made in two parts connected telescopically with a micrometric regulating device inbetween for regulating the distance of body 32 from surface 29. In a further alternative arrangement not shown, additional similar channels may be set up alongside channels 14 and 15, each for supplying tobacco to a suction belt for manufacturing more than two cigarette rods at the same time. Obviously, in this case, belt 25 would have to be wide enough to accommodate as many strips (28) as the number of the said channels provided and manufacturing machine 2 would have to be fitted with as many dividing devices (30) as the number of channels, less one unit.

I claim:

1. A machine for simultaneously manufacturing a number of continuous cigarette rods, comprising a plurality of out-going channels equal in number to said rods, a conveyor for advancing a continuous layer of shredded tobacco of a predetermined thickness in a predetermined direction of feed and at a predetermined speed of advancement towards said channels, and means cooperating with a tobacco layer conveying surface of said conveyor to divide said continuous layer into longitudinal strips equal in number to said channels and each aligned with an inlet of a respective said channel; said channels being arranged side by side and crosswise in relation to said direction of feed, and said dividing means comprising, for each pair of adjacent channels of said out-going channels, at least one pair of nozzles, and means for supplying said nozzles with a fluid under pressure; the nozzles of each said pair being arranged facing said conveying surface, and at a greater distance from said conveying surface than the thickness of said layer; said two nozzles being oriented so as to direct said fluid under pressure to impinge onto said conveying surface in respective directions, which are substantially symmetrical in relation to a plane perpendicular to said conveying surface and parallel to said direction of feed; and said two nozzles being designed so as to eject said fluid under pressure at a speed having a component parallel to, orientated as, and greater than, the speed of advancement of said conveyor.

2. Machine according to claim 1, characterised by the fact that, for each pair of the said adjacent channels (14, 15), the said pair of nozzles (42, 43) is supported on a body (32) mounted so as to turn round an axis essentially perpendicular to the said conveying surface (29); first adjustable drive means (39) being provided for setting the said supporting body (32) at any angle around the said axis.

3. Machine according to claim 2, characterised by the fact that a flap (47), arranged at a tangent to the said conveying surface (29) and essentially perpendicular to it, is connected to each said supporting body (32) from which it extends essentially parallel to the said direction of feed (26).

4. Machine according to claim 2, characterised by the fact that each said supporting body comprises a hollow body (32) with a chamber (33) inside which communicates, on one side, with the said means (41) for supplying the said fluid under pressure and, on the other, with the outside through side holes (42, 43) defining the said nozzles.

5. Machine according to claim 1, characterized by the fact that, for each pair of the said adjacent channels (14, 15), the said pair of nozzles (42, 43) is supported on a body (32) facing the said conveying surface (29) and adjustable so as to be essentially parallel to the said direction of feed (26); second drive means (37) being provided for setting the said supporting body (32) in the said direction (26).

6. Machine for manufacturing continuous cigarette rods simultaneously, comprising an in-coming feedbox for supplying shredded tobacco to a combing unit which supplies a continuous layer (28) of the said tobacco on to a conveyor belt (25) for supplying a number of out-going channels (14, 15), one for each of the said rods, the said channels being arranged side by side and crosswise in relation to the direction (26) the said belt (25) is traveling in, characterised by the fact that it comprises a dividing device (30) facing the conveying surface (29) of the said belt (25) and comprising means (41) for supplying fluid under pressure and, for each pair of the said adjacent channels (14, 15), at least one pair of nozzles (42, 43) for supplying the said fluid under pressure; the nozzles (42, 43) of each said pair being arranged facing the said coveying surface (29), at a greater distance from it than the thickness of the said layer (28), at an angle in relation to the said conveying surface (29), in the same direction (26) as that in which the said conveying surface is traveling and essentially symmetrical in relation to it; for each pair of the said adjacent channels (14, 15), the said pair of nozzles (42, 43) being supported on a body (32) mounted so as to turn round an axis essentially perpendicular to the said conveying surface (29); first adjustable drive means (39) being provided for setting the said supporting body (32) at any angle around the said axis; the speed at which the said fluid under pressure comes out of the said nozzles (42, 43) parallel to the said direction of feed (26) being greater than the speed at which the conveying surface (29) is traveling.

7. A machine according to claim 6 having a flap (47) arranged at a tangent to the conveying surface (29) and essentially perpendicular to it, and connected to each supporting body (32) from which it extends essentially parallel to the direction of feed (26).

8. A machine according to claim 6 in which each supporting body comprises a hollow body (32) with a chamber (33) inside which communicates, on one side, with the means (41) for supplying the fluid under pressure and on the other side with the outside through side holes (42, 43) defining the nozzles.

9. Machine for manufacturing continuous cigarette rods simultaneously, comprising an in-coming feedbox for supplying shredded tobacco to a combing unit which supplies a continuous layer (28) of the said tobacco on to a conveyor belt (25) for supplying a number of out-going channels (14, 15), one for each of the said rods, the said channels being arranged side by side and crosswise in relation to the direction (26) the sad belt (25) is traveling in, characterized by the fact that it comprises a dividing device (30) facing the conveying surface (29) of the said belt (25) and comprising means (41) for supplying fluid under pressure and, for each pair of the said adjacent channels (14, 15), at least one pair of nozzles (42, 43) for supplying the said fluid under pressure; the nozzles (42, 43) of each said pair being arranged facing the said conveying surface (29), at a greater distance from it than the thickness of the said layer (28), at an angle in relation to the said conveying surface (29), in the same direction (26) as that in which the said conveying surface is traveling and essentially symmetrical in relation to it; for each pair of the said adjacent channels (14, 15), the said pair of nozzles (42, 43) is supported on a body (32) facing the said conveying surface (29) and adjustable so as to be essentially parallel to the said direction of feed (26); second drive means (37) being provided for setting the said supporting body (32) in the said direction (26); the speed at which the said fluid under pressure comes out of the said nozzles (42, 43) parallel to the said direction of feed (26) being greater than the speed the said conveying surface (29) is traveling at.

* * * * *